United States Patent [19]

Dykstra et al.

[11] Patent Number: 5,066,011

[45] Date of Patent: Nov. 19, 1991

[54] FLASHING LIGHT BALL

[76] Inventors: Douglas L. Dykstra, 2469 Rocklyn St., Camarillo, Calif. 93010; Steven L. Herbruck, 355 Dalton, Ventura, Calif. 93003

[21] Appl. No.: 680,854

[22] Filed: Apr. 5, 1991

[51] Int. Cl.[5] ..... A63H 33/26; G10H 1/00; G10H 5/04; A63B 43/06

[52] U.S. Cl. ..... 273/58 G; 446/485; 446/439; 446/409; 273/65 EF; 362/809

[58] Field of Search ..... 273/58 G, 65 EF, 1.5 A, 273/213; 446/438, 439, 484, 485, 130

[56] References Cited

U.S. PATENT DOCUMENTS

| | | | |
|---|---|---|---|
| 2,903,820 | 9/1959 | Botell | 446/439 |
| 3,011,048 | 11/1961 | O'Brien | 273/58 G |
| 3,229,976 | 1/1966 | Allen | 273/58 G |
| 3,304,651 | 2/1967 | Deyerl | 446/439 |
| 3,458,205 | 7/1969 | Smith et al. | 273/213 |
| 3,580,575 | 5/1971 | Speeth | 273/58 G |
| 3,804,411 | 4/1974 | Hendry | 273/58 G |
| 3,935,669 | 2/1976 | Potrzuski et al. | 446/438 X |
| 4,701,146 | 10/1987 | Swenson | 446/130 |
| 4,801,141 | 1/1989 | Rumsey | 273/58 G X |

*Primary Examiner*—George J. Marlo
*Attorney, Agent, or Firm*—Jack C. Munro

[57] ABSTRACT

A bouncing ball within which is incorporated an activatable light in the form of a flashtube which flashes when the ball incurs a physical jolting force such as when it is being bounced. There may also be incorporated within the ball a sound annunciator which produces a sound simultaneously with the flashing of the light.

11 Claims, 1 Drawing Sheet

FLASHING LIGHT BALL

TECHNICAL FIELD

The field of this invention relates to toys and more particularly to a ball which includes a light which is activated when the ball incurs a physical jolting force such as when it is bounced.

BACKGROUND OF THE INVENTION

The use of balls as a toy is exceedingly common. There are baseballs, basketballs, footballs, tennis balls, soccer balls, superballs and so forth. Balls are intended to be thrown, caught, hit, kicked, swatted and bounced. A ball is a toy for children and/or adults. It is probably one of the oldest form of recreational type of devices on demand.

Balls are generally designed with a specific activity in mind. The ball is to be constructed in accordance with the particular activity. Generally, the bounce of a ball is important depending upon the particular activity. Tennis balls have a certain bounce, while racquetballs have another bounce. Handballs have a still further bounce, while superballs have probably the greatest bounce. In the past, the only way to achieve something new in conjunction with a ball was to (1) alter its bounce, or (2) alter its exterior appearance.

SUMMARY OF THE INVENTION

The primary objective of the present invention is to construct a ball which is designed to be illuminated upon receiving a shock force and is designed to "hold up" under repeated application of shock forces.

Another objective of the present invention is to contruct a ball which can be used as an entertainment device which causes most human beings to be completely engrossed during usage of the ball.

The ball of the present invention is to have a core and this core will normally be constructed of a translucent or transparent resin. Normally, this core will not be resilient but surrounding and encasing the core is a layer of resilient material which will cause the ball to bounce. Also, the layer surrounding the core is to be transparent or translucent. Embedded within the core is a flashtube which is operated from a battery through an electronic circuit with both being embedded in the core. The electronic circuit is constructed to be activated only upon the ball incurring a jolting force such as when the ball is bounced. The electronic circuit can also include a sound annunciator which is used to produce a buzzing sound simultaneously with the flashing of the flashtube. In order to facilitate hearing of the sound by a human being, there is to be formed through the body of the ball a hole which is to connect with the sound annunciator.

DETAILED DESCRIPTION OF THE SHOWN EMBODIMENT

Figure 1:
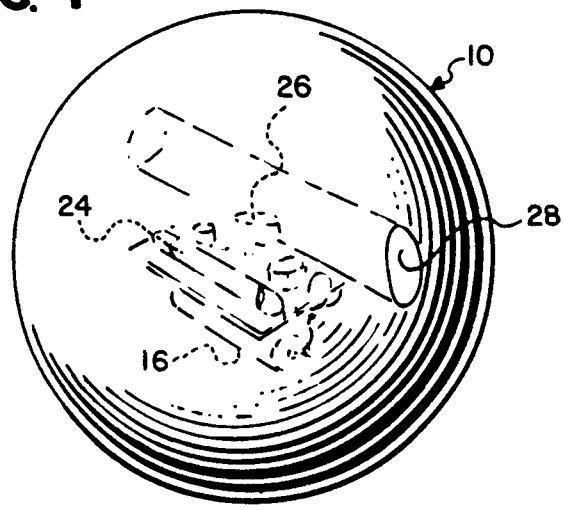
FIG. 1 is an exterior view of a ball constructed in accordance with this invention.
Figure 2:
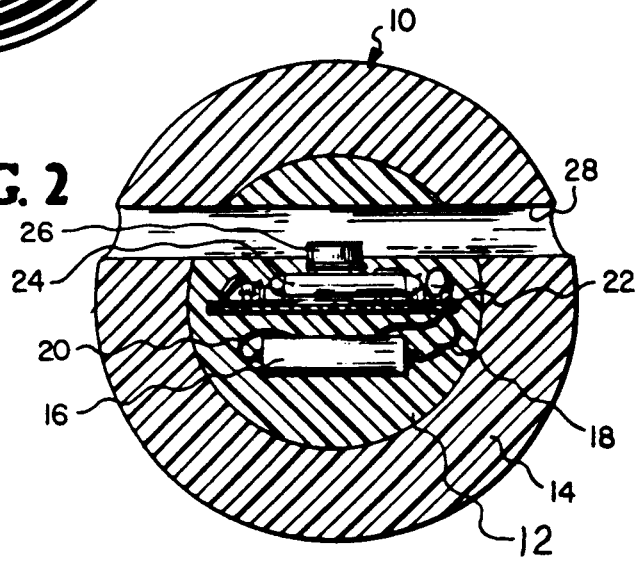
FIG. 2 is a cross-sectional view through ball of this invention showing the flashtube, sound annunciator, electronic circuitry and battery embedded within the body of the ball.

Referring particularly to FIGS. 1 and 2 of the drawing, there is shown the ball 10 of this invention. Ball 10 is shown to be spherical. However, it is within the scope of this invention that other shapes could be utilized. Ball 10 includes a body which has an inner core 12 upon which is formed an outer layer 14. The exterior appearance of both the inner core 12 and the outer layer 14 is spherical.

Figure 3:
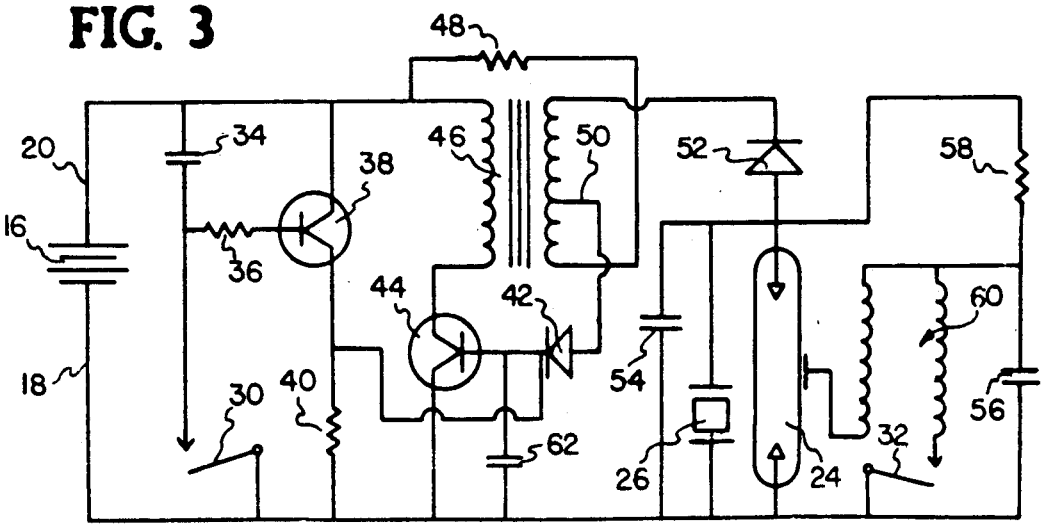
FIG. 3 is an electronic circuit diagram of the ball of the present invention.

The inner core 12 is centrally disposed within the outer layer 14. Inner core 12 will normally comprise a solid plastic resin. The resin is to be poured in a liquid state within a mold within which has been located an electrical circuit which is shown in FIG. 3. This circuit includes a battery 16 which is connected by wires 18 and 20 to a circuit board 22. Mounted on the circuit board 22 is appropriate electrical components one of which is flashtube 24. Also mounted on the circuit board 22 is a sound annunciator 26. The sound annunciator 26 connects with through hole 28 which connects with the ambient. The through hole 28 extends through both the outer layer 14 and the inner core 12. This through opening 28 may be formed after the layer 14 has been applied onto the inner core 12 or may be formed as the ball 10 is being constructed.

The resin of the core 12 must be capable of transmitting light. This means that the core 12 is at minimum translucent and may be transparent. The outer layer 14 again must also be translucent and may again be transparent. The layer 14 is of a resilient material such as a translucent silicone rubber composition. This resiliency is required so that the ball 10 will be capable of bouncing when thrown or caused to fall on an exterior surface such as a floor or wall.

It is the intention that when the ball 10 is jolted, such as would occur when the ball 10 strikes an exterior surface and is caused to bounce, that both the flashtube 24 and sound annunciator 26 be momentarily (and simultaneously) activated. The net result is that there is a short flash of light as well as a sound. Normally the battery 16 will be capable of supplying enough energy to the flashtube 24 and the annunciator 26 for somewhere in the range of fifteen thousand to one hundred and fifty thousand "bounces" of the ball 10.

In the prior art, it is common to utilize an incandescent lamp. Incandesent lamps have filaments. Filaments are easily breakable. One example of this is how easily the light bulb of a flashlight breaks when flashlight is accidently dropped.

This invention is to design a ball to incur a continuous jolting force and to "hold up" under this onslaught and continue to flash after thousands of jolts. No known filament light would be able to hold up under such abuse. It is acknowledged that there are prior patents on similar products with such patents advocating usage in an abusive manner. However, as a practical manner, these devices will not operate for any significant length of time.

The present invention overcomes this by utilizing a flashtube 24 instead of a filament type of light. Flashtubes do not have filaments, only gas that is ionized. There is no filament to break. Therefore, the flashtube 24 can take a continuous jolting force over an extended amount of time and continue to operate. Normally, the mere use of a different type of flashing bulb would not constitute patentability. However, in the present invention, the use of a flashtube in conjunction with a simple, inexpensive circuit which results in thousands of bright flashes being obtainable is deemed to be a patentable innovation. The inventors of the present invention are not aware of any such device in the prior art.

The circuit shown in FIG. 3 will now be described which causes the flashtube 24 and the sound annunciator 26 to be activated.

When the ball 10 is bounced, the switches 30 and 32 will momentarily close. Upon closing of switch 30, capacitor 34 is charged. This voltage on capacitor 34 is conducted through resistor 36 to the base of transistor 38. This voltage, which is negative, causes transistor 38 to be activated. Activation of transistor 38 produces a current flow through resistor 40 which sets up a positive voltage at the collector of transistor 38. This situation will remain until the charge of capacitor 34 decreases to a certain point below a certain preestablished voltage such as 0.7 volts. Time can be varied by increasing the size of capacitor 34. The positive voltage at the collector of transistor 38 activates the silicon controlled rectifier 42. When the silicon controlled rectifier 42 is activated, a positive voltage is applied to the base of transistor 44. This application of the positive voltage to transistor 44 occurs through the secondary winding of a transformer 46 and also through resistor 48 which activates transistor 44.

When transistor 44 becomes conductive, a current is caused to flow through the primary winding of the transformer 46. This current sets up a voltage on the primary winding of transformer 46. Because of the ratio of the primary to the secondary windings within the transformer 46, a voltage of approximately three hundred fifty volts will be produced at the secondary winding of the transformer 46. A positive feedback is supplied by conductor 50 from the secondary winding of the transformer 46 through the silicon controlled rectifier 42 to the transistor 44. Transistor 44 will then go into oscillation and will remain in this state until the silicon controlled rectifier 42 is deactivated. Diode 52 rectifies the output of the secondary winding of the transformer 46 and charges capacitor 54. At the same time, diode 52 causes capacitor 56 to be charged through resistor 58.

At the first bounce of ball 10, no light is emitted. Basically, the circuit is "turned on" and on the second and subsequent bounces of ball 10, the flashtube 24 will be activated. This will prevent drainage of the energy from the battery 16 during non-use. If the ball 10 is not bounced for thirty seconds, the circuit will be "turned off" with the next bounce not activating flashtube 24.

When the ball 10 is bounced a second time the switch 32 is closed and capacitors 54 and 56 are charged to three hundred fifty volts. Switch 32 causes a current flow through the primary winding of transformer 60. This current flow sets up a voltage on the primary winding of transformer 60 which is stepped up by the ratio established by the transformer 60 to about fifteen thousand volts. This voltage is then applied to the outside of the envelope of the flashtube 24 starting ionization of the xenon gas inside the flashtube 24. This ionization is now continued by the discharge of capacitor 54 through the flashtube 24 until the voltage reaches about one hundred fifty volts at which time the xenon gas can no longer maintain ionization. At that time, the flashtube 24 is turned off.

Continuing oscillation of transistor 44 will result in capacitors 54 and 56 being recharged and be ready for another closing of switch 32. The discharge of capacitor 54 will also cause a noise to be produced through the piezo electric transducer 26 which functions as the sound annunciator. Within the transducer 26, there is a crystal which will vibrate emitting a sound.

A further closing of the switch 30 will refresh the depleting charge in capacitor 34 which will maintain transistor 38 and the silicon controlled rectifier 42 "turned on" with the transistor 44 oscillating. Each closing of switch 30 will continue this operation. Capacitor 62 sets up an alternating current ground reference with the secondary winding of transformer 46.

If there is no closing of switch 30 for thirty seconds or more with capacitor 34 having a certain minimum value such as ten microfarads, the charge of capacitor 34 will fall below 0.7 volts which will result in deactivation of the transistor 38. This will in turn cause the silicon controlled rectifier 42 to be deactivated. This will block the positive voltage on the base of transistor 44 stopping the oscillation. Once this point has been reached, closing of switch 32 will not cause an ionization of the gas in the flashtube 24. Switch 30 must close in order to restart the process.

The previously discussed circuitry could be readily changed and not be outside the scope of this invention. In other words, the circuitry shown constitutes only one example. Another form of circuit could use light emitting diodes instead of the xenon flashtube 24. When light emitting diodes are used, the inner core 12 could be made of the same material as outer core 14.

What is claimed is:

1. A ball with a flashing light comprising:
a solid body constructed of a light transmitting material;
a light source embedded within said body, said light source comprising a flashtube;
an electronic circuit embedded within said body, said electronic circuit being connected to said flashtube; and
a battery embedded within said body, said battery being connected to said electronic circuit, said electronic circuit preventing activation of said flashtube with said body not incurring any physical jolting force, said electronic circuit causing momentary activation of said flashtube with energy being supplied from said battery when said body incurs a jolting force such as what occurs when said body is thrown against an exterior object.

2. The ball as defined in claim 1 wherein:
said body being resilient thereby causing said ball to bounce when thrown against an exterior object.

3. The ball as defined in claim 2 wherein:
said light source and said electronic circuit and said battery being embedded within a solid resin material, a layer of rubber material surrounding said resin material.

4. The ball as defined in claim 3 wherein:
said body being translucent.

5. The ball as defined in claim 3 wherein:
said body being transparent.

6. The ball as defined in claim 1 including:
an electrically activated sound annunciator included within said electronic circuit, said sound annunciator to produce a noise simultaneously with the activation of light source.

7. The ball as defined in claim 6 wherein:
said body including a hole, said hole connecting with said sound annunciator.

8. The ball as defined in claim 7 wherein:

said body being resilient thereby causing said ball to bounce when thrown against an exterior object.

9. The ball as defined in claim 8 wherein:

said light source and said electronic circuit and said battery being embedded within a solid resin material, a layer of rubber material surrounding said resin material.

10. The ball as defined in claim 9 wherein:

said body being translucent.

11. The ball as defined in claim 9 wherein:

said body being transparent.

* * * * *